US008567012B2

(12) United States Patent
Ng

(10) Patent No.: US 8,567,012 B2
(45) Date of Patent: Oct. 29, 2013

(54) AUTOMOTIVE DOOR CHECK WITH ENERGY STORAGE BODY

(75) Inventor: Billy Chean Wang Ng, Newmarket (CA)

(73) Assignee: Multimatic Inc., Ontario (CA)

( * ) Notice: Subject to any disclaimer, the term of this patent is extended or adjusted under 35 U.S.C. 154(b) by 286 days.

(21) Appl. No.: 12/933,548

(22) PCT Filed: Jan. 30, 2009

(86) PCT No.: PCT/CA2009/000125
§ 371 (c)(1),
(2), (4) Date: Sep. 20, 2010

(87) PCT Pub. No.: WO2009/124373
PCT Pub. Date: Oct. 15, 2009

(65) Prior Publication Data

US 2011/0016665 A1 Jan. 27, 2011

(30) Foreign Application Priority Data

Apr. 7, 2009 (CA) ..... 2628528

(51) Int. Cl.
*E05F 5/06* (2006.01)

(52) U.S. Cl.
USPC ..... 16/86 C; 16/85; 16/82

(58) Field of Classification Search
USPC ..... 16/86 C, 85, 86 B, 86 A, 334, 332; 292/262, 265, 269, 273, 275, 278, 292/DIG. 15; 296/146.4, 146.11, 146.12
See application file for complete search history.

(56) References Cited

U.S. PATENT DOCUMENTS

| | | | |
|---|---|---|---|
| 2,125,010 | A | 7/1938 | Wright |
| 5,039,144 | A | 8/1991 | Tolle |

(Continued)

FOREIGN PATENT DOCUMENTS

| | | | | |
|---|---|---|---|---|
| DE | 102004032250 | A1 | * | 2/2006 |
| EP | 0668476 | B1 | | 11/1998 |
| EP | 1759080 | B1 | | 8/2007 |
| JP | 7-102845 | | | 4/1995 |
| JP | 07331944 | A | * | 12/1995 |
| JP | 2001-288948 | | | 10/2001 |
| JP | 2004293249 | A | * | 10/2004 |
| WO | 2006000536 | A1 | | 1/2006 |

OTHER PUBLICATIONS

International Search Report and Written Opinion for International Application No. PCT/CA2009/000125, dated Oct. 21, 2010, 7 pages.
"PCT International Search Report dated Apr. 9, 2009 for PCT/CA2009/000125, from which the instant application is based," 3 pgs.
Machine translation of abstract of JP7 7-102845 published Apr. 18, 1995 (OI Seisakusho Co Ltd).

*Primary Examiner* — Chuck Mah
(74) *Attorney, Agent, or Firm* — Fredrikson & Byron, P.A.

(57) ABSTRACT

A door check apparatus for an automobile comprises a unitary check body containing a pair of compliant leaves and a guidance arrangement which is adapted to be rigidly mounted to a vehicle door. It also comprises a check arm containing cam surfaces and detent features which is pivotally connected to a vehicle body structure and is configured to slideably interface with the guidance arrangement of the unitary check body. The unitary check body is manufactured from a resilient material so that the compliant leaves are capable of storing and releasing energy in response to the movement of the cam surfaces and detent features of the check arm relative to the guidance arrangement. Rotary motion of the vehicle door relative to the vehicle body structure is checked with predetermined forces generated from the energy stored and released by the compliant leaves at positions determined by the relationship between the detent features of the check arm relative to the guidance arrangement of the unitary check body.

29 Claims, 6 Drawing Sheets

(56) References Cited

U.S. PATENT DOCUMENTS

| | | | | |
|---|---|---|---|---|
| 5,173,991 | A * | 12/1992 | Carswell | 16/86 A |
| 6,370,733 | B2 | 4/2002 | Paton et al. | |
| 6,438,794 | B2 * | 8/2002 | Ng et al. | 16/82 |
| 6,711,778 | B2 * | 3/2004 | Sparkman | 16/86 C |
| 6,842,943 | B2 | 1/2005 | Hoffmann et al. | |
| 7,640,627 | B2 * | 1/2010 | Lowen et al. | 16/86 C |
| 7,686,353 | B2 * | 3/2010 | Lewis et al. | 292/19 |
| 2004/0244683 | A1 | 12/2004 | Beckord | |
| 2006/0150367 | A1 * | 7/2006 | Matsuki | 16/86 C |
| 2006/0207059 | A1 * | 9/2006 | Van Den Heuvel | 16/86 B |
| 2008/0066260 | A1 | 3/2008 | Clark | |

* cited by examiner

AUTOMOTIVE DOOR CHECK WITH ENERGY STORAGE BODY

RELATED APPLICATIONS

This application is a 35 U.S.C. 371 national stage filing from International Application No. PCT/CA2009/000125 filed Jan. 30, 2009, which claims priority to Canadian Patent Application No. 2,628,528, filed Apr. 7, 2008, the teachings of which are incorporated herein by reference.

FIELD OF THE INVENTION

This invention relates to automotive door check devices, and in particular to a compact mechanical device capable of holding an automotive door in a number of predetermined open positions with a predetermined force.

DESCRIPTION OF THE PRIOR ART

It has been found useful to check the movement of an automotive door in a number of predetermined open positions to assure convenient and safe ingress/egress of the occupants. The door is normally checked against movement in at least one open position with an effort or resistive force adequate to resist wind gusts and the effect of parking on an incline or grade.

The most common form of automotive door check apparatus is a mechanical device that resists motion by releasably storing energy in response to forced motion of the system. These devices, located between the vehicle's body structure and door, can be configured to be integral with the door hinge or separate as autonomous mechanical assemblies. Energy storage is generally achieved by a form of spring with coil and torsion arrangements being the most popular configurations. As the door is opened or closed, the door check apparatus is configured to release energy entering the check positions and to store it when moving out of the check positions. The most common method of storing energy in the spring system is by means of a cam arrangement that moves in conjunction with the door. This cam can work within the hinge to ultimately produce a torque around the pivot axis of the hinge, or can work linearly in a separate checking apparatus which produces a force vector to resist door movement at selected opening positions.

U.S. Pat. No. 5,173,991 to Carswell describes a common type of separate door checking apparatus that utilizes a molded link member to provide a cam arrangement and a pair of coil springs to releasably store energy. The coil springs are contained in a check housing and are acted upon by the molded link member via ball bearings and ball bearing retainers. The check housing is rigidly attached to the vehicle door and the molded link member is pivotally connected to the vehicle body structure. The device of Carswell provides a robust, reliable and relatively compact solution for checking the movement of an automotive door. There are numerous similar solutions that utilize rollers or sliders in place of the ball bearings of Carswell. U.S. Pat. No. 6,370,733 to Paton et. al. describes a separate checking apparatus that utilizes a molded link member or check arm and rollers. U.S. Pat. No. 6,842,943 to Hoffmann et. al. describes a separate checking apparatus that utilizes a molded check arm and sliders.

Because the automotive door check apparatus must be located between the vehicle's body structure and door, it is forced to occupy a severely restricted package space as there is limited clearance between the vehicle body structure and the door and very little volume available within the door.

Additionally, the weight of the automotive door check apparatus must not be too great as a significant proportion of the door check apparatus mass resides within the door profile, which swings on a pivot and is highly sensitive to weight. In general, the manufacturing costs of automotive components are among the lowest of any comparable industry and so simple solutions with low part counts are highly desirable. The main focus of an automotive door check development is to attain the required check efforts in the smallest possible package at the lowest achievable weight and cost. Using as few components as possible is highly desirable. The type of spring and its related strain energy storage capability combined with the package efficiency of the actuation mechanism ultimately dictate the overall effectiveness of the automotive door check apparatus.

GENERAL DESCRIPTION OF THE INVENTION

Accordingly, it would be advantageous to create an automotive door check apparatus that provides identical functional performance to the prior art configurations but does so with fewer components and moving parts than these existing arrangements.

The present invention reduces the complexity, weight and cost of an automotive door check apparatus by combining the functions of the check housing and mounting bracket with that of the energy storage device. This combining of functions eliminates the requirement for separate springs, multiple piece check housings and ball bearings, rollers or sliders as utilized by the prior art devices. The door check apparatus of the present invention is reduced to two moving parts from a minimum of seven in the prior art arrangements.

The present invention replaces the check housing, mounting bracket and springs of the conventional prior art automotive door check apparatus with a single piece unitary check body manufactured from a resilient material capable of storing and releasing energy. This unitary check body is rigidly attached to the vehicle door via a mounting face and is configured with a pair of compliant leaves and a guidance arrangement. A check arm is configured with detent features and cam surfaces and is adapted to pivotally connect to the vehicle body structure and pass into the vehicle door through a suitable access opening. The unitary check body is rigidly attached to the vehicle door at the access opening. The check arm is adapted to move through the unitary check body and slideably interface with the guidance arrangement in response to rotary motion of the vehicle door relative to the vehicle body structure. This relative rotary motion is checked with predetermined forces at positions determined by the relationship between the detent features of the check arm relative to the guidance arrangement of the unitary check body. The predetermined check forces are generated from the energy stored and released by the compliant leaves of the unitary check body. The compliant leaves of the unitary check body store and release energy in response to the motion of the guidance arrangement as it is forced to follow the profile of the detent features and cam surfaces of the check arm as the check arm moves through the unitary check body. As is common in the art, the predetermined check forces act primarily along the centerline axis of the check arm and the check arm is installed with an offset to the hinge swing centerline so as to induce a checking moment to resist relative rotary motion between the vehicle door and vehicle body structure. In this manner the automotive door check apparatus of the present invention provides identical check force and moment generation to the devices of the prior art with only two primary components.

In a further aspect of the present invention the check arm is configured with a pivot boss and is pivotally connected to a mounting bracket via a pivot rivet. The mounting bracket is then rigidly mounted to the vehicle body structure via bolting, welding, bonding, riveting or similar fastening means.

In a preferred embodiment of the present invention the check arm is formed from a moldable plastic material and contains a metallic reinforcement co-molded within the plastic material.

In a further aspect of the present invention the check arm is configured with a bump stop that is adapted to pass through the guidance arrangement of the unitary check body with no contact. The vehicle door is prevented from further rotation at its full open swing limit by the bump stop contacting the unitary check body at its mounting face. In this manner the stop loads associated with preventing further rotation of the vehicle door are transferred directly to the vehicle door structure rather than through the unitary check body. This allows the unitary check body to be optimized for the single function of generating the predetermined checking forces via the compliant leaves rather than also being required to carry full open stop loads. This bump stop arrangement is a primary differentiator over the prior art in which the check housings are configured to withstand the full open swing limit stop loads.

In a preferred embodiment of the present invention an energy absorber is incorporated into the bump stop of the check arm so that when it contacts the backside of the mounting face of the unitary check body the kinetic energy carried by the moving vehicle door is dissipated. By dissipating the kinetic energy in a controlled manner the vehicle door is prevented from bouncing closed when it reaches the full open swing limit.

In an additional aspect of the present invention the check arm is adapted to accept a paint clip device that is configured with additional detent features and cam surfaces. The paint clip device is configured to provide additional check positions as required during the paint and assembly process of the vehicle. The paint clip device is configured to be easily removable from the check arm after the paint and assembly process. In this way the automotive door check apparatus of the present invention is capable of providing a temporary check position at the vehicle door full closed limit to facilitate painting prior to the door latch being installed.

In a preferred embodiment of the present invention the unitary check body is manufactured from a high strength steel or a similar compliant but strong material. The mechanical properties of this resilient material, the geometric configuration of the compliant leaves and the profile shape of the detent features and cam surfaces are configured so that the resilient material never exceeds its elastic limit within the operating range of the automotive door check apparatus.

In further aspects of the present invention:

a) the unitary check body contains a pair of compliant leaves and a guidance arrangement, and is adapted to be rigidly mounted to a vehicle door via bolting, welding, bonding, riveting or similar fastening means;

b) the unitary check body is manufactured from a high strength steel so that the compliant leaves are capable of storing and releasing energy;

c) the check arm contains a bump stop, cam surfaces and detent features, and is pivotally connected to the vehicle body structure via a mounting bracket and pivot rivet arrangement and configured to slideably interface with the guidance arrangement of the unitary check body;

d) the check arm is formed from a moldable plastic material and contains a reinforcement co-molded within the plastic material;

e) the bump stop feature incorporates an energy absorbing material co-molded with the plastic material of the check arm;

f) the mounting bracket is rigidly mounted to the vehicle body via bolting, welding, bonding, riveting or similar fastening means;

such that rotary motion of the vehicle door relative to the vehicle body structure is checked with predetermined forces generated from the energy stored and released by the compliant leaves of the unitary check body, at positions determined by the relationship between the detent features of the check arm relative to the guidance arrangement, and the vehicle door is prevented from further rotation at its full open swing limit by the bump stop feature contacting the unitary check body at its mounting surface so that stop loads associated with preventing further rotation are transferred directly to the vehicle door structure, and the vehicle door is prevented from bouncing closed by the energy absorbing material.

Further aspects of the invention will become apparent from the following description.

DETAILED DESCRIPTION OF THE INVENTION

Figure 1:
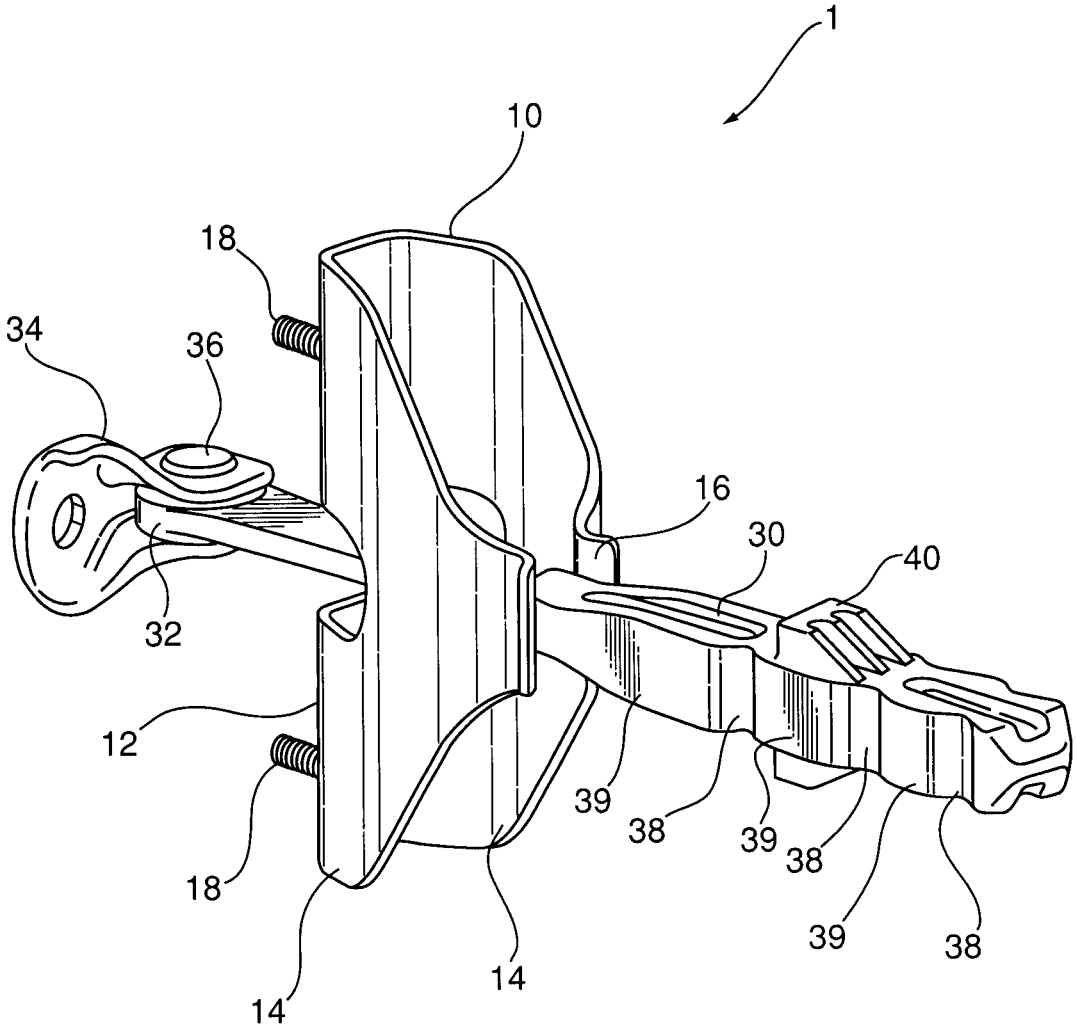
FIG. 1 is a perspective view of the inventive automotive door check apparatus.
Figure 2:
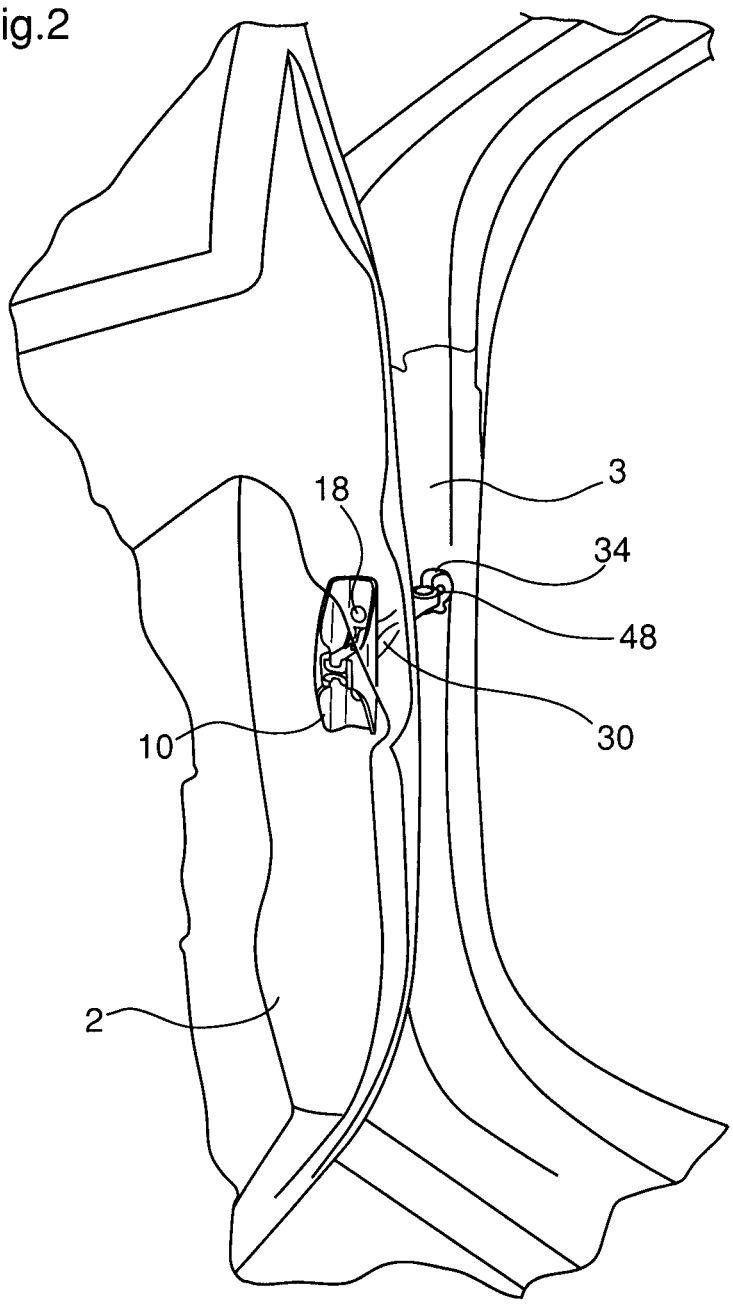
FIG. 2 is a perspective view of the inventive automotive door check apparatus in a typical automotive installation.
Figure 3:
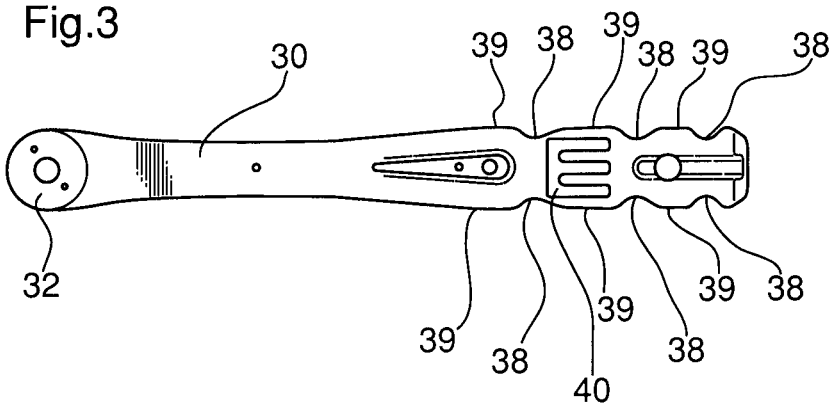
FIG. 3 is a plan view of the check arm of the inventive automotive door check apparatus.

Referring to FIGS. 1 and 3, an automotive door check apparatus (1) consists of a unitary check body (10) and a check arm (30). The unitary check body (10) is configured with a mounting face (12), a pair of compliant leaves (14), a guidance arrangement (16) and at least one mounting fastener (18). The check arm (30) is configured with a pivot boss (32), a mounting bracket (34), a pivot rivet (36), detent features (38), cam surfaces (39) and a bump stop (40). Referring to FIGS. 1 and 2, the unitary check body (10) is adapted to rigidly attach to a vehicle door (2) via its at least one mounting fastener (18). The check arm (30) is adapted to rigidly mount to a vehicle body structure (3) via its mounting bracket (34) and at least one attachment fastener (48). The check arm (30) is configured to rotate around its pivot rivet (36) and to move through the unitary check body (10) and slideably interface with the guidance arrangement (16).

Relative rotary motion between the vehicle door (2) and vehicle body structure (3) causes the check arm (30) to move through the unitary check body (10) and slideably interface with the guidance arrangement (16) forcing the compliant leaves (14) to move in response to the cam surfaces (39) and detent features (38) of the check arm (30).

The unitary check body (10) is manufactured from a resilient material capable of storing and releasing energy while generating predetermined contact forces in response to the displacement of the compliant leaves (14). The mechanical properties of the resilient material, geometric configuration of the compliant leaves (14) and profile shape of the detent features (38) and cam surfaces (39) are configured so that the resilient material never exceeds its elastic limit within the operating range of the automotive door check apparatus (1). In a preferred embodiment of the present invention the unitary check body (10) resilient material is a high strength steel. In an alternative embodiment of the present invention the unitary check body (10) resilient material is a high strength composite or a similar compliant but strong material.

When the check arm (30) moves through the unitary check body (10) it slideably interfaces with the guidance arrangement (16) and the compliant leaves (14) move into the detent features (38) releasing energy and lowering their contact forces. As the check arm (30) continues to move through unitary check body (10) and slideably interface with the guidance arrangement (16) the complaint leaves (14) move out of the detent features (38) and up onto the cam surfaces (39) increasing their contact forces and storing energy. The contact forces in combination with the profile shape of the detent features (38) generate predetermined checking forces along the axis of the check arm (30). Relative rotary motion of the vehicle door (2) and the vehicle body structure (3) is checked by the predetermined checking forces at positions determined by the relationship between the detent features (38) of the check arm (30) relative to the guidance arrangement (16).

Figure 5:
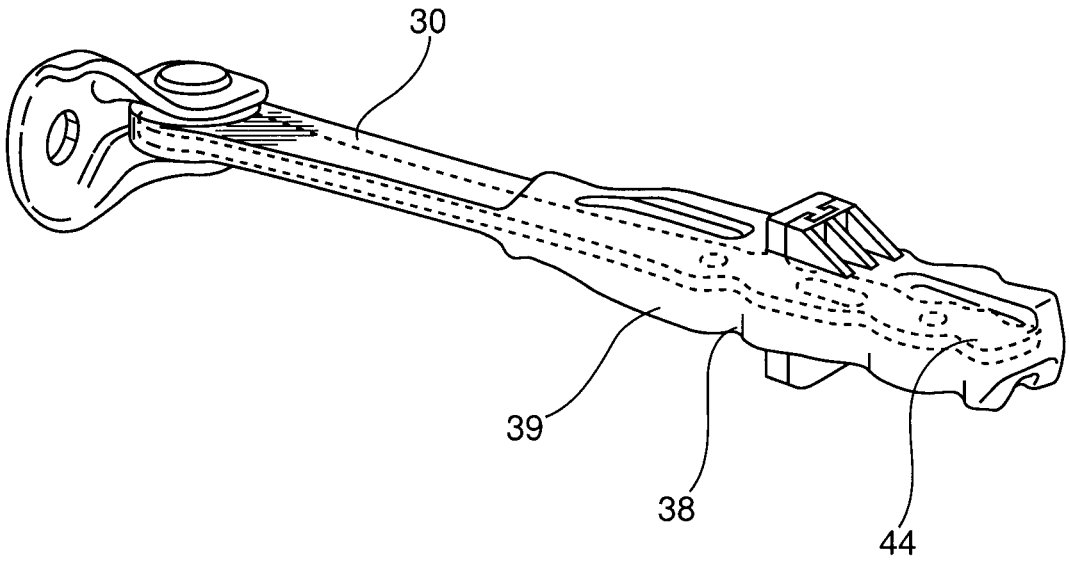
FIG. 5 is a perspective view of the check arm of the inventive automotive door check apparatus showing partial interior detail.

In a preferred embodiment of the present invention the check arm (30) is formed from a moldable plastic material which integrally includes the detent features (38), cam surfaces (39), pivot boss (32) and bump stop (40). Referring to FIG. 5, a further aspect of the preferred embodiment is illustrated in which the molded plastic check arm (30) contains a co-molded reinforcement (44) manufactured from steel, aluminum, reinforced plastic or a similar structural material.

Figure 4:
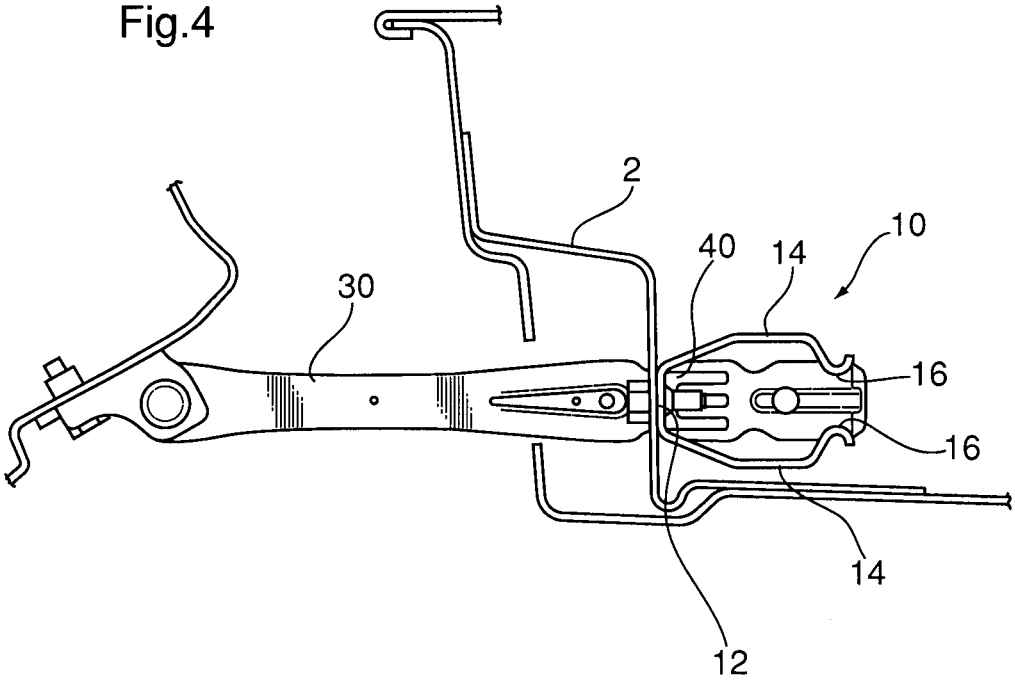
FIG. 4 is a plan view of the inventive automotive door check apparatus shown with the vehicle door at its full open swing limit.

FIG. 4 illustrates a further aspect of the door check apparatus, showing the vehicle door (2) at its full open swing limit and the bump stop (40) in contact with the backside of the mounting face (12) of the unitary check body (10). Further rotation of the vehicle door (2) is prevented by the bump stop (40) transferring the stop loads directly from the check arm (30) into the vehicle door structure through the single material thickness of the mounting face (12) of the unitary check body (10). The short load path between the bump stop (40) and vehicle door structure allows the unitary check body (10) to be optimized for the single function of generating the predetermined checking forces via the compliant leaves (14) rather than also being required to carry full open stop loads. This bump stop arrangement is a primary differentiator over the prior art in which the check housings are configured to withstand the full open swing limit stop loads.

Figure 6:
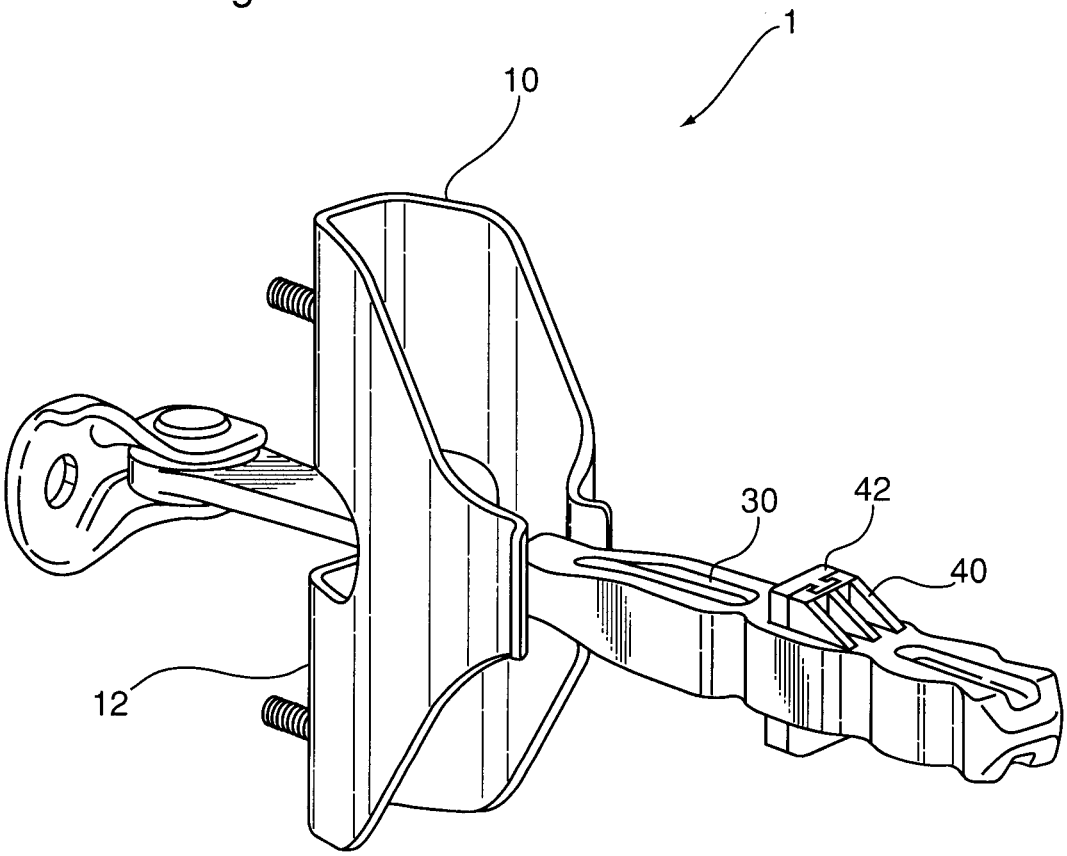
FIG. 6 is a perspective view of an alternative embodiment of the inventive automotive door check apparatus.

A preferred embodiment of the bump stop (40) of the check arm (30) is illustrated in FIG. 6. An energy absorber (42) is incorporated into the bump stop (40) so that when it contacts the backside of the mounting face (12) of the unitary check body (10) the kinetic energy carried by the moving vehicle door (2) is dissipated thereby preventing the vehicle door (2) from bouncing closed when it reaches the full open swing limit. In a further aspect of this preferred embodiment, the energy absorber (42) is co-molded with check arm (30).

Figure 7:
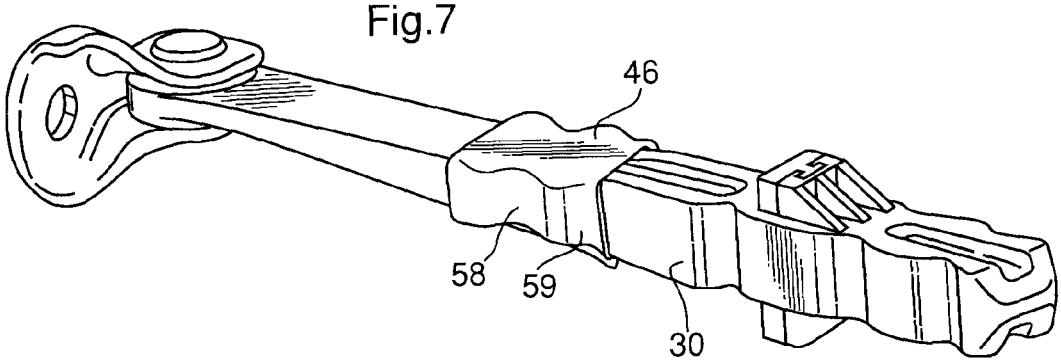
FIG. 7 is a perspective view of a further alternative embodiment of the inventive automotive door check apparatus including a paint clip device.
Figure 8:
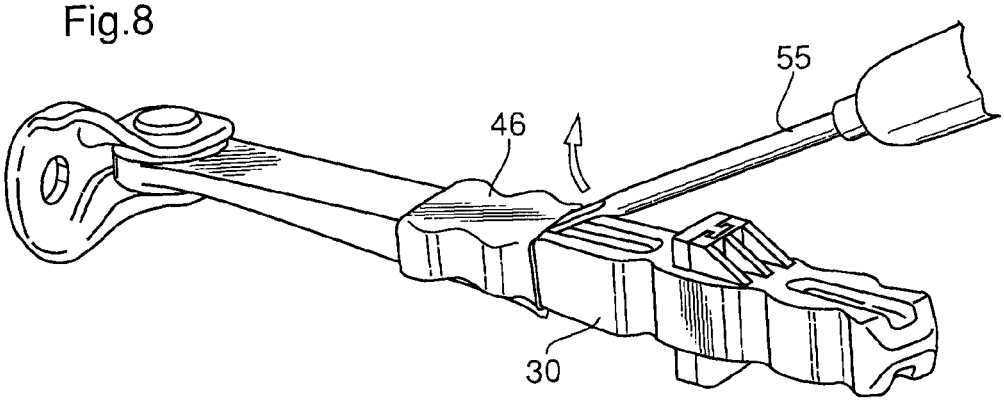
FIG. 8 is a perspective view of a further alternative embodiment of the inventive automotive door check apparatus illustrating removal of the paint clip device.
Figure 9:
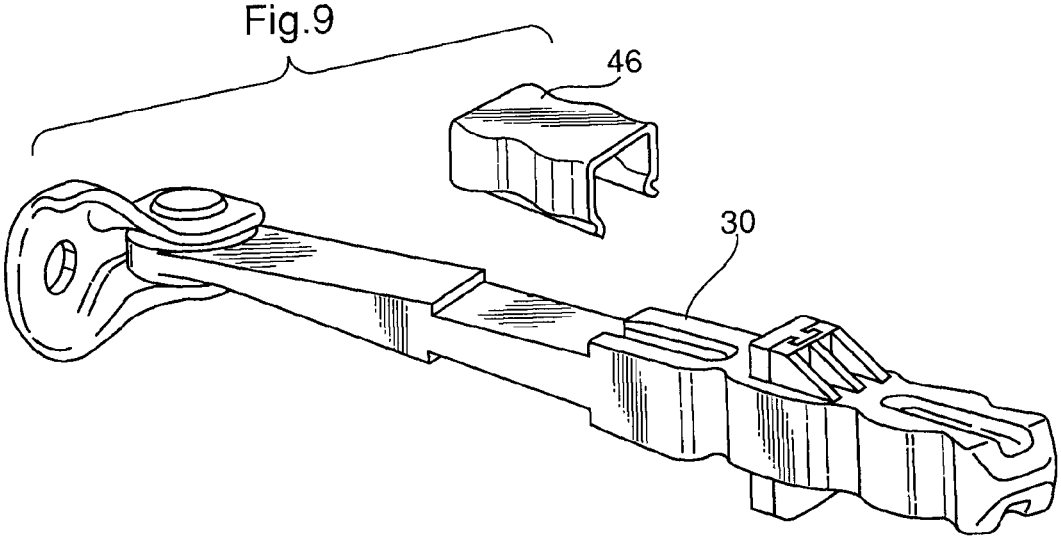
FIG. 9 is a perspective view of a further alternative embodiment of the inventive automotive door check apparatus with the paint clip device removed.

As illustrated in FIGS. 7, 8 and 9, in a further aspect of the present invention, the check arm (30) is adapted to accept a paint clip device (46) that is configured with additional detent features (58) and cam surfaces (59). The paint clip device (46) is configured to provide additional check positions as required during the painting and assembly process of the vehicle. The paint clip device (46) is configured to be easily removable from the check arm (30) after the painting and assembly process. FIG. 8 illustrates the paint clip device (46) being removed from the check arm (30) using a screwdriver (55) to pry it free and FIG. 9 shows the check arm (30) with the paint clip device (46) completely removed. In this way the automotive door check apparatus (1) of the present invention is capable of providing a temporary check position at the vehicle door (2) full closed limit to facilitate painting prior to the door latch being installed.

The invention claimed is:

1. A door check apparatus for an automobile comprising:

a) a unitary check body comprising a mounting surface configured to rigidly mount to a vehicle door, a pair of opposing compliant leaves that extend substantially perpendicularly from the mounting surface, each compliant leaf having a free end, and a guidance arrangement defined by the free end of each compliant leaf;

b) a check arm configured to be pivotally connected to a vehicle body structure, the check arm comprising cam surfaces and detent features that slideably interface with the guidance arrangement of the unitary check body;

wherein the unitary check body is manufactured from a resilient material so that the compliant leaves are capable of storing and releasing energy in response to the sliding interface of the cam surfaces and detent features of the check arm relative to the guidance arrangement; and wherein the compliant leaves of the unitary check body are configured to generate predetermined forces at positions determined by the locations of the detent features of the check arm relative to the guidance arrangement of the unitary body check, thereby checking rotary motion of the vehicle door relative to the vehicle body structure.

2. The door check apparatus of claim 1, wherein the unitary check body resilient material is a high strength steel.

3. The door check apparatus of claim 1, wherein the unitary check body resilient material is a high strength composite material.

4. The door check apparatus of claim 1, wherein the check arm is formed from a moldable plastic material.

5. The door check apparatus of claim 4, wherein the check arm contains a reinforcement co-molded within the plastic material.

6. The door check apparatus of claim 5, wherein the check arm reinforcement is manufactured from steel, aluminum, reinforced plastic or a similar structural material.

7. The door check apparatus of claim 1, wherein the check arm is formed from a metallic material by at least one of casting or forging.

8. The door check apparatus of claim 1, wherein the unitary check body is configured to be rigidly mounted to the vehicle door via at least one of bolting, welding, bonding, and riveting.

9. The door check apparatus of claim 1, wherein the check arm is configured to be pivotally connected to the vehicle body structure via a mounting bracket and pivot rivet arrangement.

10. The door check apparatus of claim 9, wherein the mounting bracket is configured to be rigidly mounted to the vehicle body structure via at least one of bolting, welding, bonding, and riveting.

11. The door check apparatus of claim 1, further comprising a paint clip device, wherein the check arm is adapted to accept said paint clip device.

12. The door check apparatus of claim 11, wherein the paint clip device is configured with additional detent features and cam surfaces.

13. The door check apparatus of claim 12, wherein the paint clip device is configured to provide additional check positions as required during a painting and assembly process.

14. The door check apparatus of claim 12, wherein the paint clip device is configured to be easily removable from the check arm after a painting and assembly process.

15. The door check apparatus of claim 1, wherein the check arm contains a bump stop feature that is configured to contact the unitary check body at a full open swing limit of the vehicle door so as to prevent further rotation.

16. The door check apparatus of claim 15, wherein the bump stop feature is adapted to contact the mounting surface of the unitary check body so that the stop loads associated with preventing further rotation are transferred directly to the vehicle door structure.

17. The door check apparatus of claim 16, wherein the bump stop feature incorporates an energy absorbing material configured to prevent the vehicle door from bouncing closed when it reaches the full open swing limit.

18. A door check apparatus for an automobile comprising:

a) a unitary check body comprising a mounting surface configured to rigidly mount to a vehicular door via at least one of bolting, welding, bonding, and riveting, a pair of opposing compliant leaves that extend substantially perpendicularly from the mounting surface, each compliant leaf having a free end, and a guidance arrangement defined by the free end of each compliant leaf;

b) said unitary check body being manufactured from a high strength steel so that the compliant leaves are capable of storing and releasing energy;

c) a check arm configured to be pivotally connected to a vehicle body structure via a mounting bracket and pivot rivet arrangement, the check arm comprising cam surfaces and detent features that are configured to slideably interface with the guidance arrangement of the unitary check body;

d) said check arm being formed from a moldable plastic material and containing a reinforcement co-molded within the plastic material;

e) said mounting bracket of said check arm being configured to be rigidly mounted to the vehicle body via at least one of bolting, welding, bonding, and riveting;

such that rotary motion of the vehicle door relative to the vehicle body structure is configured to be checked with predetermined forces generated from the energy stored and released by the compliant leaves of the unitary check body, at positions determined by the relationship between the detent features of the check arm relative to the guidance arrangement of the unitary check body.

19. The door check apparatus of claim 18, wherein the check arm contains a bump stop feature that is configured to contact the unitary check body at a full open swing limit of the vehicle door so as to prevent further rotation.

20. The door check apparatus of claim 19, wherein the bump stop feature is adapted to contact the mounting surface of the unitary check body so that the forces associated with preventing further rotation are transferred directly to the vehicle door structure.

21. The door check apparatus of claim 20, wherein the bump stop feature incorporates an energy absorbing material configured to prevent the vehicle door from bouncing closed when it reaches the full open swing limit.

22. The door check apparatus of claim 21, wherein the energy absorbing material is co-molded with the plastic material of the check arm.

23. The door check apparatus of claim 18, further comprising a paint clip device, wherein the check arm is adapted to accept said paint clip device configured to provide additional check positions as required during a painting and assembly process.

24. The door check apparatus of claim 23, wherein the paint clip device is configured with additional detent features and cam surfaces.

25. The door check apparatus of claim 24, wherein the paint clip device is configured to be easily removable from the check arm after the painting and assembly process.

26. A door check apparatus for an automobile comprising:

a) a unitary check body containing comprising a mounting surface configured to rigidly mount to a vehicle door via at least one of bolting, welding, bonding, and riveting, a pair of opposing compliant leaves that extend substantially perpendicularly from the mounting surface, each compliant leaf having a free end, and a guidance arrangement defined by the free end of each compliant leaf;

b) said unitary check body being manufactured from a high strength steel so that the compliant leaves are capable of storing and releasing energy;

c) a check arm configured to be pivotally connected to a vehicle body structure, the check arm comprising a bump stop, cam surfaces and detent features, the cam surfaces and detent features being configured to slideably interface with the guidance arrangement of the unitary check body;

d) said check arm being formed from a moldable plastic material and containing a reinforcement co-molded within the plastic material;

e) said bump stop feature incorporating an energy absorbing material co-molded with the plastic material of the check arm;

f) said mounting bracket of said check arm being configured to be rigidly mounted to the vehicle body via at least one of bolting, welding, bonding, and riveting;

such that rotary motion of the vehicle door relative to the vehicle body structure is configured to be checked with predetermined forces generated from the energy stored and released by the compliant leaves of the unitary check body, at positions determined by the relationship between the detent features of the check arm relative to the guidance arrangement, and the vehicle door is prevented from further rotation at its full open swing limit by the bump stop feature contacting the unitary check body at its mounting surface so that stop loads associated with preventing further rotation are transferred directly to the vehicle door structure, and the vehicle door is prevented from bouncing closed by the energy absorbing material.

27. The door check apparatus of claim 26, further comprising a paint clip device, wherein the check arm is adapted to accept said paint clip device configured to provide additional check positions as required during a painting and assembly process.

28. The door check apparatus of claim 27, wherein the paint clip device is configured with additional detent features and cam surfaces.

29. The door check apparatus of claim 28, wherein the paint clip device is configured to be easily removable from the check arm after the painting and assembly process.

* * * * *